United States Patent [19]

Siegfried

[11] Patent Number: 4,648,853

[45] Date of Patent: Mar. 10, 1987

[54] WHEEL HUB LOCKING MECHANISM

[75] Inventor: Rand Siegfried, San Carlos, Calif.

[73] Assignee: Lewis Galoob Toys, Inc., South San Francisco, Calif.

[21] Appl. No.: 785,873

[22] Filed: Oct. 9, 1985

[51] Int. Cl.[4] ..... A63H 17/26; A63H 17/00; B60B 15/20; B60B 15/22

[52] U.S. Cl. ..... 446/448; 180/7.1; 280/5.2; 301/45; 446/431; 446/457

[58] Field of Search ..... 446/431, 448, 457, 460, 446/461, 462, 463, 465; 301/41 R, 43, 45, 46, 48, 50, 51; 180/7.1; 280/5.2

[56] References Cited

U.S. PATENT DOCUMENTS

| | | |
|---|---|---|
| 247,792 | 10/1881 | Wood . |
| 1,228,895 | 6/1917 | Foecke . |
| 1,253,722 | 1/1917 | Priel . |
| 1,305,303 | 10/1917 | Nelson . |
| 1,326,500 | 12/1919 | Henderson . |
| 1,389,269 | 8/1921 | Polansky . |
| 1,537,491 | 5/1925 | Palmer . |
| 1,542,206 | 6/1925 | Anthony . |
| 1,578,478 | 3/1926 | Spescha . |
| 1,781,461 | 11/1930 | Huenemann . |
| 1,825,394 | 9/1931 | Gnaegy . |
| 1,890,872 | 12/1932 | Van Kleeck . |
| 1,923,196 | 8/1933 | Fortescue . |
| 1,997,835 | 4/1935 | Sandherr . |
| 2,924,486 | 2/1960 | Blaschke . |
| 3,112,783 | 12/1963 | Muetz . |
| 4,547,173 | 10/1985 | Jaworski et al. ..... 446/465 X |

FOREIGN PATENT DOCUMENTS

| | | |
|---|---|---|
| 302565 | 4/1919 | Fed. Rep. of Germany . |
| 1532724 | 6/1967 | France . |
| 464159 | 4/1937 | United Kingdom . |

*Primary Examiner*—F. Barry Shay

*Attorney, Agent, or Firm*—Limbach, Limbach & Sutton

[57] ABSTRACT

A wheel assembly for toy vehicles that includes a spider mounted for rotation inside of a generally cylindrical hollow wheel. The spider carries lugs for extension and retraction through passages in the peripheral wall of the wheel. Also carried by the wheel for rotation relative to the wheel, and for rotational engagement with the spider, is a hub manually rotatable from outside of the wheel. The spider is biased for rotation in direction by one spring and the spider and hub are biased apart in an axial direction by another spring. Another spring biases the hub which has a flange with a number of notches against a sidewall of the wheel having a detent that fits into the notches to latch the hub into a lugs locked out, lugs locked in or neutral position.

20 Claims, 11 Drawing Figures

WHEEL HUB LOCKING MECHANISM

BACKGROUND OF THE INVENTION

1. Field of the Invention

This invention relates generally to toy vehicles and more particularly to a wheel assembly for toy vehicles.

2. Background Art

Toy vehicles, in particular, toy vehicles having a feature that facilitates the ability of the vehicle to climb over various surfaces and obstacles are popular playthings. U.S. patent application Ser. No. 678,023 filed Dec. 4, 1984 discloses a toy vehicle having wheels inside of which are a number of pivotally mounted claws that are automatically driven out when the wheel encounters a rough surface or obstruction that tends to cause the wheel to slip. After the vehicle overcomes the obstruction with the aid of the extended claws, a spring retracts the claws back into the wheel. It would, however, be desirable to have a wheel with extendable claws or lugs that can be manually locked in the extended position or locked in the retracted position to increase play opportunities.

SUMMARY OF THE INVENTION

The present invention is concerned with providing a wheel assembly for a toy vehicle in which lugs, mounted within the interior of the wheel, are, by manual rotation of a hub from outside of the wheel, moveable and latchable into an extended position or a retracted position. These and other objects and advantages of the invention are achieved by a hollow wheel having a peripheral wall with a number of spaced apart passages and a spider assembly mounted for rotation within the wheel with a lug pivotally mounted to the free end of each arm of the spider. Coaxially mounted with the spider is a hub assembly that has a portion projecting out through an opening in the outer sidewall of the wheel for manual operation. Rotation of the hub moves the lugs out through the passages and back again. One spring mounted inside the wheel urges rotation of the spider in one direction while another spring exerts an axial bias urging the hub out through the opening in the sidewall. The hub has a flange with a number of notches that cooperate with a raised detent on the inside of the outer sidewall to latch the hub in the desired position under the urging of the axial bias.

BRIEF DESCRIPTION OF THE DRAWINGS

For a better understanding of the present invention reference may be had to the accompanying drawings in which:

FIG. 6 is a sectional view taken generally along line 6—6 of FIG. 4;

FIG. 7 is a sectional view taken generally along line 7—7 of FIG. 6 with a portion broken away;

FIG. 8 is a reduced scale exploded parts view of the wheel assembly;

FIG. 9 is a reduced scale showing of the rotational position of the hub and spider locking the lugs in;

FIG. 10 is a reduced scale showing the neutral position of the hub and spider; and FIG. 11 is a reduced scale showing of the rotational position of the hub and spider locking the hubs out.

DETAILED DESCRIPTION OF THE PREFERRED EMBODIMENT

Figure 1:
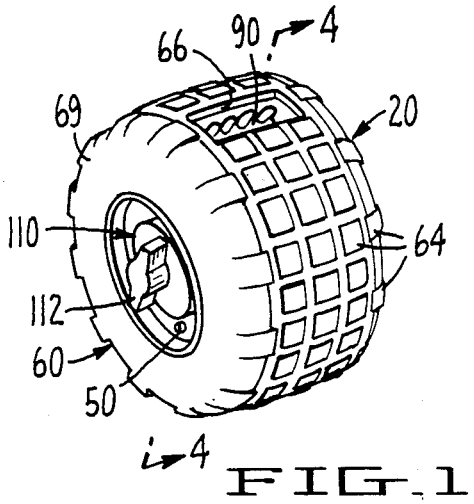
FIG. 1 is a perspective view of a wheel assembly embodying the present invention.
Figure 3:
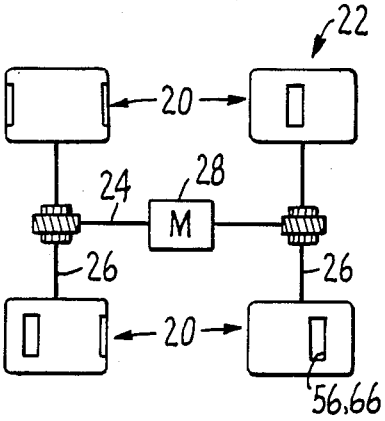
FIG. 3 is a reduced scale, schematic view of a toy vehicle with wheel assemblies of the present invention.
Figures 6, 7, 8, 9, 10, 11:
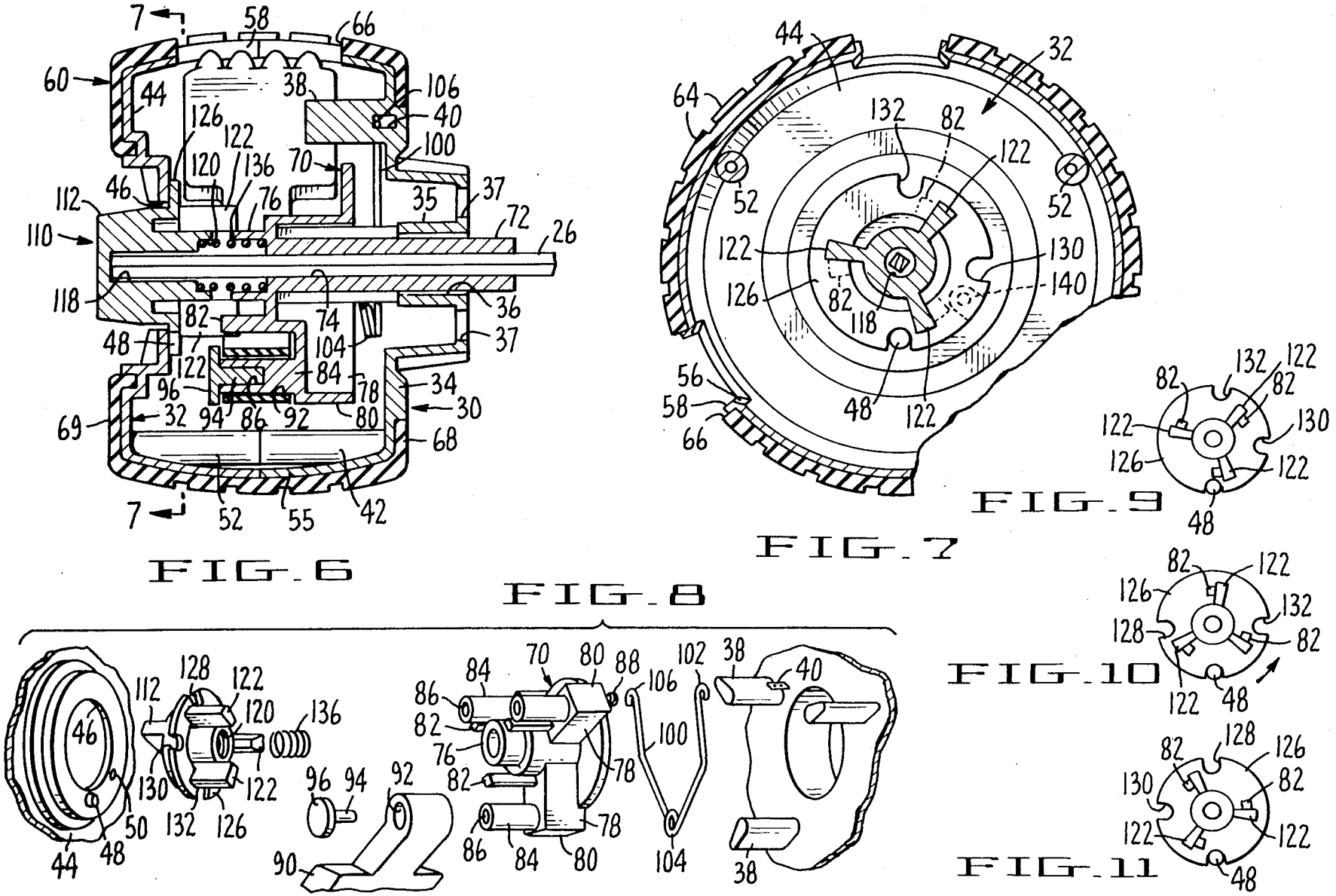

Referring now to the drawings in which like parts are designated by like reference characters throughout the several views, there is shown in FIG. 1 a wheel assembly 20 for a toy vehicle 22 schematically shown in FIG. 3 with a chassis 24 carrying spaced apart axles 26 which may be square shafts as illustrated in FIG. 6. On each end of each of the axles 26 is a wheel 20. A motor 28, which may be any one of a number of conventional battery spring or inertia motors for toy vehicles, is mounted on the chassis and drivingly connected by conventional means to one or both of the axles.

Each wheel 20 is a generally hollow cylinder formed of an inner shell half 30 and an outer half 32 made of a relatively rigid plastic. Inner half 30 has a sidewall 34 in the approximate center of which is an inwardly projecting boss 35 with a central opening 36. Around the boss there are a number of soil dislodging holes 37 extending through sidewall 34 that facilitate dislodging soil from inside the hollow shell. Equally spaced about a circumference intermediate the center and the periphery of the inner half are three guidestop pillars 38 extending out from the sidewall. One of the pillars has a cutout 40 adjacent the sidewall. Adjacent the periphery of the sidewall are three, again equally spaced apart, locating mounting posts 42.

Outer shell half 32 has a sidewall 44 with a generally central opening 46 that is larger than the opening 36 in the inner half. Between the opening and the periphery of sidewall 44, is a raised detent 48. Circumferentially spaced from detent 48 is an aperture 50 extending through sidewall 44. Three locating mounting posts 52 are spaced apart adjacent the periphery of the outer half sidewall for mating with locating posts 42 on the inner half.

When assembled with mating mounting posts secured by screws (not shown), adhesives or the like, the inner and outer half of the shell form a peripheral wall 55 of a predetermined thickness, axial width and circumference. Extending through the thickness of the peripheral wall are a number, in this preferred embodiment three, of passages 56. Each of the passages is spaced apart approximately equidistantly about the circumference of the peripheral wall and extends across a little more than one-half of the axial width of the wall. On the side of each passage, generally parallel to the axis of the wheel, are upwardly or outwardly extending rims 58 of a predetermined height.

A tire 60 is molded of rubber or some other suitable flexible material to fit over the assembled shell halves 30 and 32. Tire 60 has a peripheral wall 62 of a predetermined thickness, axial width and circumference. The outer surface of the peripheral wall is formed with a plurality of raised triad portions 64. Extending through wall 62 are three equidistantly spaced apart passages 66. Radially extending in from peripheral wall 62 are an inner sidewall 68 and an outer sidewall 69. The inner sidewall 68 is relatively short facilitating slipping the flexible tire 60 on over the assembled shell halves 30 and 32 to further secure them. Raised rims 58 on either side of passages 56 through the shell peripheral wall help to maintain passages 66 through the tire in register.

Inside the wheel is a spider 70 that has a center post 72 with a square bore 74 extending through the post for mounting the spider on an axle 26 for rotation with the axle. The inwardly directed end of the post has a relatively large diameter shallow blind bore forming a cup 76. Spider 70 has three radially extending arms 78, each of which has a free end 80. Intermediate the center post and free end, a finger 82 projects out from the outwardly directed side of each arm, generally parallel to the center post. Also extending out, generally parallel to the center post, on the same side as the fingers 82, but at the free end of each arm, is a mounting post 84. Each mounting post has a generally central bore 86. On the side of the spider directed toward sidewall 34 is a tab 88.

An elongated lug 90 has a bore 92 transverse to the elongated direction of the lug at one end of the lug. The other end of the lug may be formed in the shape of a claw or some other design suggesting gripping. While lug 90 is generally straight along its elongated direction, a slight curve is provided adjacent the claw end. The slight curve together with the tear-shaped pillars facilitates extension of the lug out through a passage 56 and 66. Bore 92 fits over mounting post 84 relatively loosely permitting pivotal movement of the lug about the mounting post. A pin 94, with an enlarged head 96, fits tightly into bore 86 securing the lug to the mounting post while permitting pivotal movement. As an alternative to pin 94, a threaded screw or the like could be used to secure the lug on the mounting post.

Figure 4:
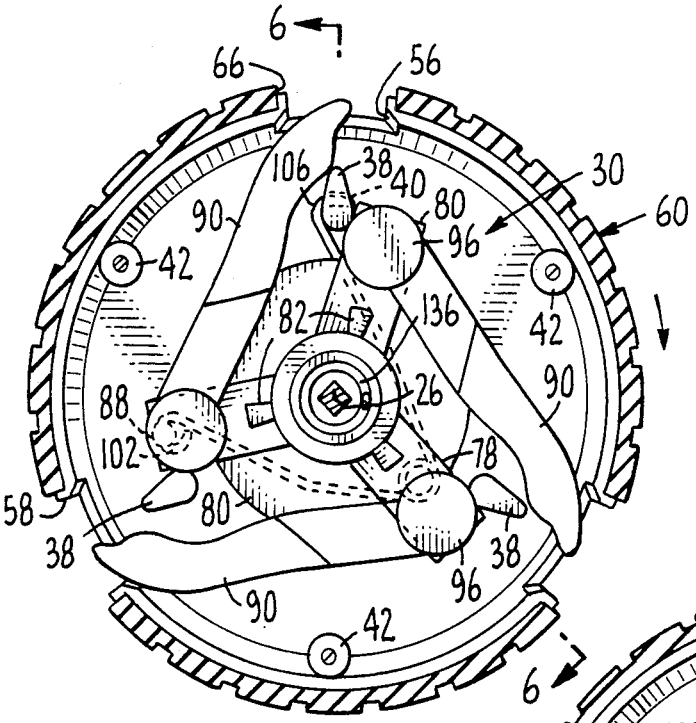
FIG. 4 is an enlarged scale, sectional view taken generally along line 4—4 of FIG. 1.
Figure 5:
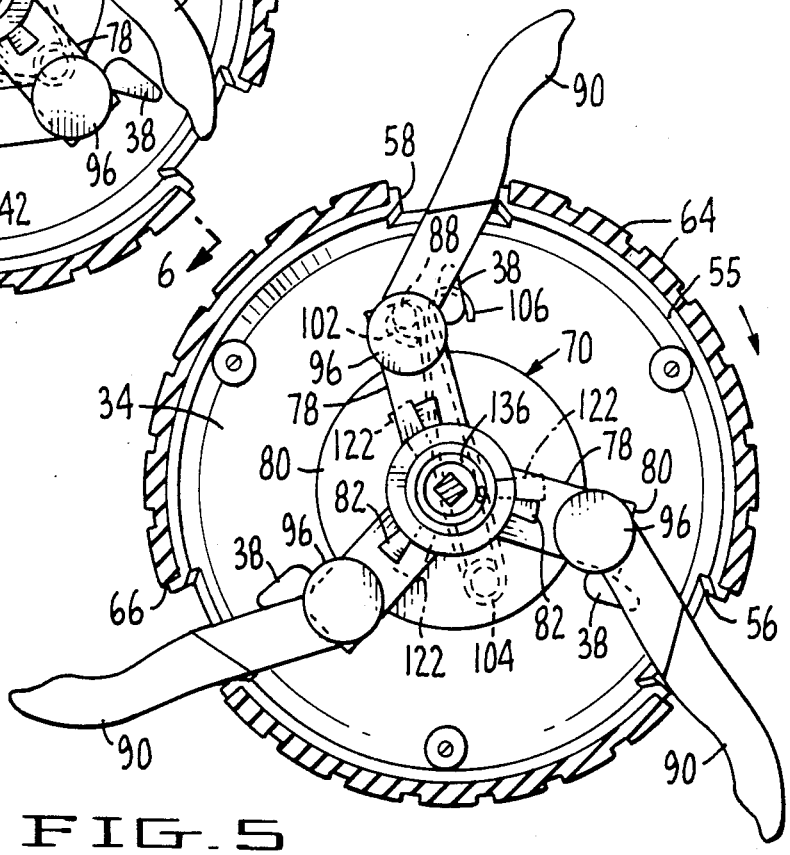
FIG. 5 is an enlarged scale, sectional view taken generally along line 5—5 of FIG. 2.

Rotationally biasing the spider with its pivotally mounted lugs relative to the inner shell, and hence the wheel, is a torsion spring 100 with a hook 102 at one end, an intermediate coil 104 and a loop 106 at the other end. Hook 102 is engaged in cutout 40 of one of the pillars 38 while loop 106 fits over the inwardly directed tab 88 adjacent the free end of one of the arms 78. In the embodiment shown, as is best illustrated in FIGS. 4 and 5, the rotational biasing spring 100 urges the spider to rotate in one direction, namely, the lug retracting direction. Accordingly, if the selected forward direction of rotation of the wheels of the toy vehicle is in opposition to the direction urged by spring 100, the motor 28 driving the axles 26 will tend to drive the lugs out through the passages 56 and 66 when the wheel 20 encounters an obstruction.

Carried by the wheel for rotation relative to the wheel, coaxial with the spider, is a hub 110. One side, the external side, of hub 110 has a bar or knob handle 112 generally transverse to the axis of the hub facilitating manual rotation of the hubs The internal side of hub 110 has a two step blind bore with the inside, deeper bore 118 being generally round and of a diameter sufficiently larger than the width of axle 26 to permit the hub to rotate freely relative to the axle. An outer larger diameter shallow bore forms a cup 120. Spaced at generally equidistant intervals about the bore and extending radially and inwardly generally parallel to the axis are three fingers 122. Intermediate the external and internal sides, hub 110 has a flange 126. Spaced at generally equidistant intervals around approximately half of flange 126 are three notches 128, 130 and 132, each of which may selectively cooperate with the raised detent 48 on the inside of sidewall 44 of the outer shell half. Opposite ends of an axial biasing coil spring 136 are seated in the cup 76 of the spider and cup 120 of the hub to urge the flange 126 against the inside of sidewall 44 around opening 46. Accordingly, hub 110 will be latched into one of three positions, depending upon which of notches 128, 130 or 132 is in register with detent 48. However, by pushing hub 110 inwardly against the axial biasing force of coil spring 136, the notch may be disengaged from the detent permitting hub 110 to be rotated. Selected portions of flange 126, on its side adjacent sidewall 44, are provided with indicators 140, such as a differently colored portion, to register with, and be viewable through, aperture 50 to provide an indication of the rotational position of the hub.

Figure 2:
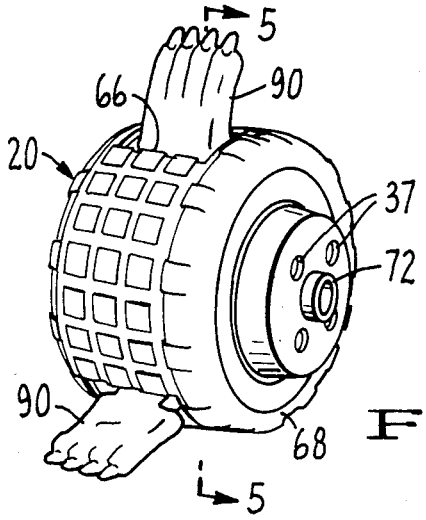
FIG. 2 is a perspective view of the wheel assembly shown in FIG. 1 with the lugs extending out.

Fingers 122 of the hub will engage fingers 82 of the spider to transmit manual rotation of the hub to the spider. When, hub 110 is rotated in a clockwise direction as illustrated by the arrow in FIGS. 4 and 5, fingers 122 will engage fingers 82 and rotate spider 80 in the same clockwise direction against the bias of spring 100 urging the spider to rotate in the opposite direction, to extend lugs 90 out through passages 56 and 66 in the assembled shell and tire, respectively. With lugs 90 fully extended, as illustrated in FIGS. 2 and 5, a portion of each arm 78, adjacent its free end 80, will abut guide-stop pillar 38, restricting further rotation of the hub and spider assembly. Hub 110 will then be in the rotational position illustrated in FIG. 11 with notch 132 engaging detent 48. It will be appreciated, that if hub 110 is pushed in against the bias of coil spring 136 and suddenly released, the rotational biasing force of spring 100 will automatically retract lugs 90.

Rotating hub 110 to the intermediate position with notch 130 in register with detent 48 latches hub 110 in a neutral position, as shown in FIG. 10. The intermediate, neutral position permits driving engagement through axle 26 to rotate the spider and extend the lugs out through the passages. In the neutral position, driven rotation of the spider in the direction illustrated by the arrow in FIG. 10 will permit rotation of the spider approximately one hundred degrees, before finger 82 of the spider engages the next finger 122 of the hub which is sufficient to extend the lugs.

If hub 110 is rotated to and latched in the position shown in FIG. 9 with notch 128 in register with detent 48 lugs 90 are locked in the retracted position within the wheel.

While a particular embodiment of the present invention has been illustrated and described with some alternatives, further changes and modifications will become apparent to those skilled in the art without departing from the true scope of the invention.

What is claimed as new and desired to be secured by Letters Patent is:

1. A wheel assembly for a toy vehicle comprising:

a generally cylindrical, hollow shell having an axis coinciding with the axis of rotation of the wheel assembly, spaced apart opposed sidewalls, one of which has an opening generally aligned with said axis, and a peripheral wall of a predetermined thickness, axial width and circumference;

a plurality of passages extending through the thickness of the peripheral wall at spaced intervals around the circumference;

a spider having a number of radially extending arms carried in said assembly for rotation relative to said shell about the axis inside the shell;

each said arm having a free end; an elongated lug pivotally mounted on each said arm adjacent the free end;

rotational biasing means mounted in said assembly urging the spider to rotate in one direction relative to said shell;

a hub having an outer side and an inner side; the hub being carried by the shell adjacent the one sidewall and for rotation relative to said shell about the axis with the outer side accessible for manual rotation;

means on the inner side of the hub for engaging the spider so that rotation of the hub effects rotation of the spider to move the part of each lug into and out of the shell through the passages;

axial biasing means mounted within said shell urging a portion of the hub against the one sidewall; and positioning means on the hub cooperating with the one sidewall for latching the hub in either of two rotational positions corresponding to the part of each lug being either fully extended out of the shell or retracted inside the shell.

2. The wheel assembly of claim 1 in which: the shell is made of a relatively rigid material;

a tire made of a relatively flexible material as compared to the material of the shell fits over the shell; and the tire has a peripheral wall of a predetermined thickness with a plurality of passages that register with the passages extending through the peripheral wall of the shell.

3. The wheel assembly of claim 2 in which at least one of the sides of a passage through the shell has a raised, outwardly extending rim of a height less than the tire peripheral wall thickness.

4. The wheel assembly of claim 1 in which the portion urged by the axial biasing means against the one sidewall is a flange intermediate the extremities of the outer side and the inner side.

5. The wheel assembly of claim 4 in which the hub is carried with the outer side projecting out through the opening in the one sidewall and the flange is urged against the inside of the one sidewall.

6. The wheel assembly of claim 5 in which the positioning means comprise notches on the flange that cooperate with a raised detent on the inside of the sidewall.

7. The wheel assembly of claim 5 in which the one sidewall has an aperture and the flange has indicator means viewable through the aperture to indicate from outside the shell that the hub is in one of the two rotational positions.

8. The wheel assembly of claim 1 in which:

the rotational biasing means urges the spider to rotate in a direction retracting the lugs inside the shell;

the wheel assembly is mountable on an axle with the spider in driving engagement with the axle; and the positioning means also provides for latching the hub in a third rotational position in which rotation of the axle in opposition to the rotational biasing means extends a part of each lug out of the shell.

9. The wheel assembly of claim 1 in which each passage extends across at least one-third of the axial width.

10. The wheel assembly of claim 1 in which each passage extends across at least one-half of the axial width.

11. The wheel assembly of claim 1 in which the part of the lug extended out through the passage has a slight curve.

12. A toy wheeled vehicle with a wheel assembly mounted thereon comprising:

a relatively rigid, generally cylindrical, hollow shell including an axis coinciding with the axis of rotation of the wheel assembly, spaced apart sidewalls and a peripheral wall of a predetermined thickness and circumference;

a plurality of passages extending through the thickness of the peripheral wall at approximately equidistant points along the circumference;

one of the sidewalls having a generally centrally disposed opening;

a tire of a material that is more flexible than that of the shell and fits tightly over the shell;

the tire having a plurality of passages that align with the passages in the peripheral wall of the shell;

a spider coaxially mounted within the shell for rotation about the axis relative to the shell;

the spider having a number of radially extending arms;

each of the arms attached at one end adjacent the axis of the spider and having a radially extending free end;

first biasing means mounted within said shell and biasing the spider in one rotational direction relative to said shell;

an elongated extendable member pivotally connected at one end to the free end of each radially extending arm for pivotal movement about an axis generally parallel to said axis of rotation;

a hub with a flange mounted on said shell for manual rotation about said axis of rotation relative to the shell and for movement along said axis of rotation;

engaging means on the hub and spider cooperating upon manual rotation of the hub to move the other end of each of the extendable members into and out of the wheel through a respective passages one of said aligned passages extending through the shell and tire;

second biasing means axially biasing the hub relative to the shell; and means on the hub and the shell cooperating to selectively latch the hub in either of two rotational positions relative to the shell with the second biasing means cooperating with the latching means to retain the hub in one of the two rotational positions.

13. The toy vehicle of claim 12 including:

a motor-driven axle;

the axle drivingly engaging the spider; said hub having a neutral position intermediate the two rotational positions; and the latching means also cooperating to selectively latch the hub in the neutral position permitting engagement of the spider with the axle to drive the other end of each extendable member out of a respective passage.

14. The wheel assembly of claim 12 in which:

the tire has a peripheral wall of a predetermined thickness; and at least one of the sides of a passage through the shell has a raised, outwardly extending rim of a height less than the tire peripheral wall thickness.

15. The wheel assembly of claim 12 in which the hub is carried with the outer side projecting out through the opening in the one sidewall and the flange is urged against the inside of the one sidewall by the second biasing means.

16. The wheel assembly of claim 15 in which the latching means comprise notches on the flange that cooperate with a raised detent on the inside of the sidewall.

17. The wheel assembly of claim 15 in which the one sidewall has an aperture and the flange has indicator means viewable through the aperture to indicate from outside the shell that the hub is in one of the two rotational positions.

18. The wheel assembly of claim 12 in which each passage extends across at least one-third of the axial width.

19. The wheel assembly of claim 12 in which each passage extends across at least one-half of the axial width.

20. The wheel assembly of claim 12 in which each of the extendable members has a slight curve adjacent the other end.

* * * * *